US010960269B1

(12) United States Patent
Lu

(10) Patent No.: US 10,960,269 B1
(45) Date of Patent: Mar. 30, 2021

(54) UNDERWATER MOTIVE DEVICE

(71) Applicant: ACADIA International INC., Taichung (TW)

(72) Inventor: Fa-Hsing Lu, Taichung (TW)

(73) Assignee: ACADIA INTERNATIONAL INC., Taichung (TW)

( * ) Notice: Subject to any disclaimer, the term of this patent is extended or adjusted under 35 U.S.C. 154(b) by 0 days.

(21) Appl. No.: 16/673,586

(22) Filed: Nov. 4, 2019

(51) Int. Cl.

| | |
|---|---|
| ***B63C 11/46*** | (2006.01) |
| ***A63B 35/12*** | (2006.01) |
| ***B63H 25/02*** | (2006.01) |
| ***B63H 1/26*** | (2006.01) |
| ***B63C 11/02*** | (2006.01) |

(52) U.S. Cl.
CPC ..... *A63B 35/12* (2013.01); *B63C 11/02* (2013.01); *B63H 1/26* (2013.01); *B63H 25/02* (2013.01); *B63C 2011/028* (2013.01); *B63H 2025/024* (2013.01)

(58) Field of Classification Search
CPC ... B63H 1/00; B63H 1/02; B63H 1/12; B63H 1/14; B63H 1/26; B63H 5/00; B63H 5/14; B63H 5/15; B63H 5/16; B63H 5/165; B63H 25/00; B63H 25/02; B63H 2025/024; B63C 11/02; B63C 2011/028; A63B 35/00; A63B 35/08; A63B 35/10; A63B 35/12
USPC ..... 114/312, 313, 315, 330, 331, 337, 338; 440/6, 38, 40, 46, 49, 53, 66, 67, 71, 72, 440/76, 78, 79, 83, 84, 87
See application file for complete search history.

(56) References Cited

U.S. PATENT DOCUMENTS

| | | | | |
|---|---|---|---|---|
| 3,789,788 A * | 2/1974 | Peroni | A63B 35/12 | 114/315 |
| 5,379,714 A * | 1/1995 | Lewis | B63C 11/46 | 114/315 |
| 6,848,385 B2 * | 2/2005 | Mah | B63C 11/46 | 114/315 |
| 7,000,559 B2 * | 2/2006 | Mah | B63C 11/46 | 114/315 |
| 8,011,314 B2 * | 9/2011 | McGeever | B63C 11/46 | 114/315 |

* cited by examiner

*Primary Examiner* — Daniel V Venne
(74) *Attorney, Agent, or Firm* — Chun-Ming Shih; HDLS IPR Services

(57) ABSTRACT

An underwater motive device includes a rear main housing including two opposite handle bar elements on two sides respectively, and longitudinal rear joining projections on an inner surface; a power mechanism in the rear main housing; a propeller driven by a driving shaft of the power mechanism; a bridging housing including a battery compartment, a forward joining member, a shoulder abutted the forward joining member, and a rear joining member; a hollow intermediate housing including two opposite handle bar members on two sides respectively, the handle bar members joined the handle bar elements, longitudinal front joining projections on an inner surface, and an internal annular limit element at a front end; and a front cone including a rear opening and a structure on an inner surface for securing to the forward joining member of the bridging housing.

10 Claims, 10 Drawing Sheets

UNDERWATER MOTIVE DEVICE

BACKGROUND OF THE INVENTION

1. Technical Field

The technical field relates to underwater motive devices, and more particularly relates to an underwater motive device having improved characteristics for assembling parts.

2. Description of Related Art

Underwater motive devices have been known for the last several decades. Most of those earlier devices were metal. As a result, the underwater motive devices were large and bulky. The early underwater motive devices were also expensive and heavy. Thus, the only effective market was professional divers because of both the cost and strength required to handle the unit under water.

There is a commercially available underwater motive device having a plastic rear main housing. The underwater motive device can eliminate typical drawbacks including large and bulky main housing, expensive, and limited to professional divers. Further, it can be mass produced for cost reduction and is light weight and portable. However, safety is an issue to be addressed. Thus, structural strength of the conventional underwater motive device is required to be very high. Further, manufactures have to take waterproofness of the conventional underwater motive device into consideration. Furthermore, how to prevent a cover of a battery storage space of the conventional underwater motive device from being opened accidentally is another issue to be considered.

Thus, the need for improvement still exists.

SUMMARY OF THE INVENTION

The disclosure is directed to an underwater motive device for eliminating drawbacks including those associated with the conventional art.

It is therefore one object of the invention to provide an underwater motive device comprising a rear main housing including two opposite handle bar elements on two sides respectively, and a plurality of longitudinal rear joining projections on an inner surface; a power mechanism disposed in a rear portion of the rear main housing and including a driving shaft extending out of a rear end of the rear main housing; a propeller driven by the driving shaft; a bridging housing including a battery compartment, a forward joining member, a shoulder between the forward joining member and an intermediate portion of the bridging housing, and a rear joining member; an intermediate housing being a hollow cylinder and having two ends open, the intermediate housing including two opposite handle bar members on two sides respectively, the handle bar members configured to join the handle bar elements in a mated relationship to form two opposite handle bars, a plurality of longitudinal front joining projections on an inner surface, and an internal annular limit element at a front end wherein the bridging housing is in the intermediate housing, the front joining projections of the intermediate housing are aligned with the rear joining projections of the rear main housing, the annular limit element urges against the shoulder of the bridging housing in a front end to a rear end direction, and the forward joining member of the bridging housing extends out of a front end of the intermediate housing; and a front cone including a rear opening and a structure on an inner surface for securing to the forward joining member of the bridging housing.

In one of the exemplary embodiments, the forward joining member includes an annular front end, an annular front surface between the annular front end and the shoulder, two opposite first rails on a joining portion of the annular front end and the annular front surface, a first limit member extending rearward out of an end of each of the first rails, and a first space on the annular front surface and abutting each of the first rails, and two opposite sets of a second rail, a second limit member extending forward out of an end of the second rail, and a second space disposed forwardly of the second rail, the sets of the second rail, the second limit member, and the second space are on a rear internal, annular surface; and in an assembly of the front cone and the forward joining member, the second rails contact the forward joining member by disposing on the annular front surface, and each of the second rails further moves to the first space which is rearward of each of the first rails so that the second rails are anchored by the first rails and a rear end of the front cone is releasably secured to the forward joining member.

In one of the exemplary embodiments, there are further provided a first limit member extending rearward out of an end of each of the first rails, and a second limit member extending forward out of an end of each of the second rails, a movement distance of the second rail is limited by the first limit member and a movement distance of the first rail is limited by the second limit member respectively.

In one of the exemplary embodiments, the front cone further comprises an aperture on the rear end, and the intermediate housing further comprises a detent on a front end of an outer surface, the detent including a trigger configured to either insert into the aperture to secure the front cone and the intermediate housing together in a locked position or disengage from the aperture to separate the intermediate housing from the front cone in an unlocked position.

In one of the exemplary embodiments, the intermediate housing further comprises a seat on an inner surface of a front portion, a limit hole adjacent to the seat, and two opposite tabs in the limit hole; the detent further comprises two flexible latches extending from the trigger, a protrusion extending outward from each of the latches, and a hook at each of the latches; the hook is configured to movably dispose in the limit hole to secure to the tab and further lock the detent in the locked position with the protrusions disposed forwardly of the tabs; and the trigger is configured to press to unlock the detent in the unlocked position with the protrusions disposed rearward of the tabs.

In one of the exemplary embodiments, the rear joining member includes a rear annular member urging against the spaced, projected circular arcs, an O-ring disposed on the rear annular member, and a fastening seat disposed rearward of the rear annular member for joining the rear main housing.

In one of the exemplary embodiments, the shoulder radially, outwardly extends a predetermined distance out of the bridging housing.

In one of the exemplary embodiments, width of a portion of the shoulder contacting the fastening seat is greater than an outer diameter of the forward joining member.

The invention has the following advantages and benefits in comparison with the conventional art: the housings are made of plastic. Its assembly is easy. Its structural strength is greatly improved. It is highly safe to operate. Its maintenance, charging and battery replacement are convenient. The front cone provides a waterproof mechanism for preventing water from entering due to inadvertent operation. The power mechanism is cost effective and light in weight.

The above and other objects, features and advantages of the invention will become apparent from the following detailed description taken with the accompanying drawings.

DETAILED DESCRIPTION OF THE INVENTION

Figure 1:
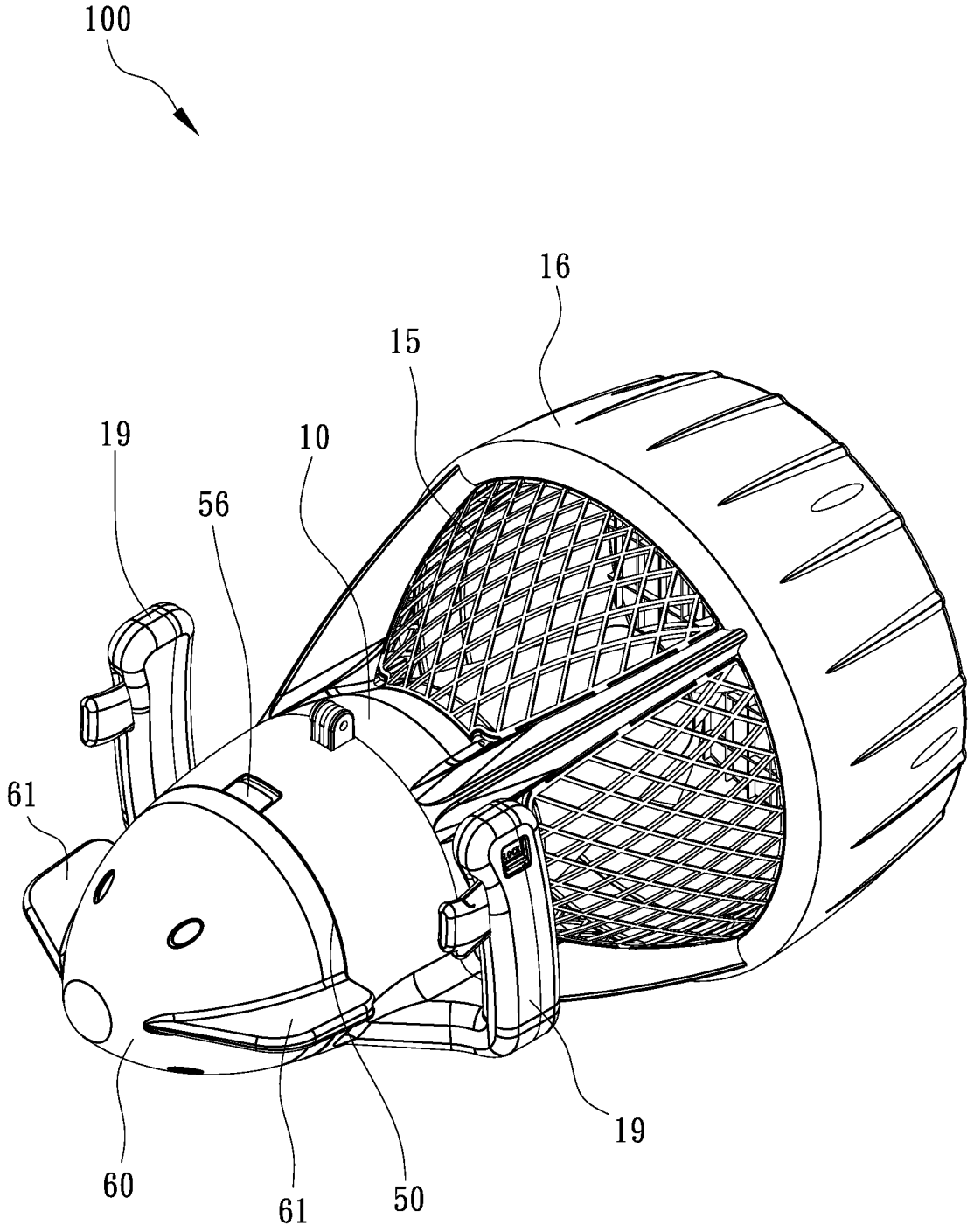
FIG. 1 is a perspective view of an underwater motive device according to a preferred embodiment of the invention.
Figure 2:
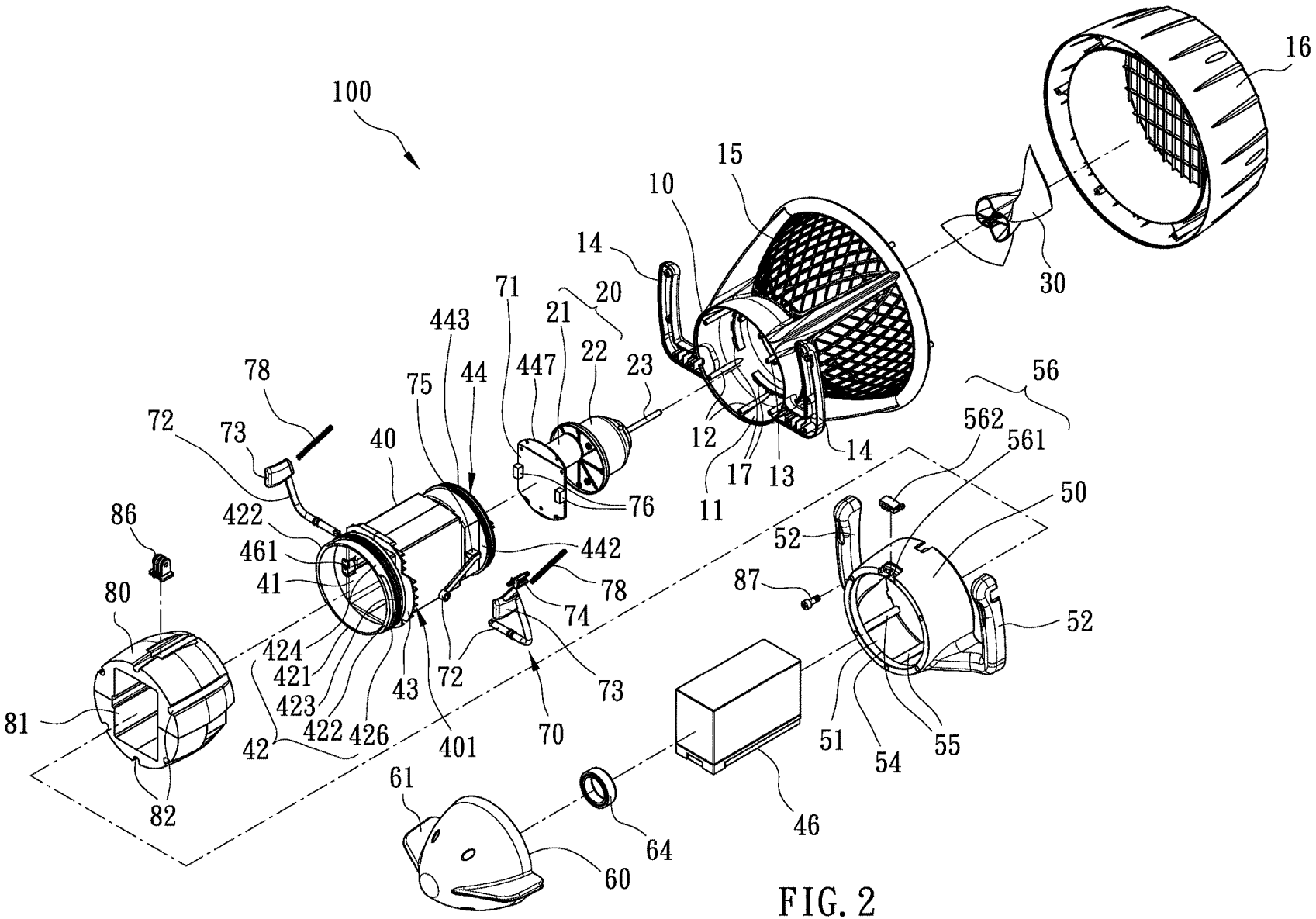
FIG. 2 is an exploded view of the underwater motive device of FIG. 1.
Figure 3:
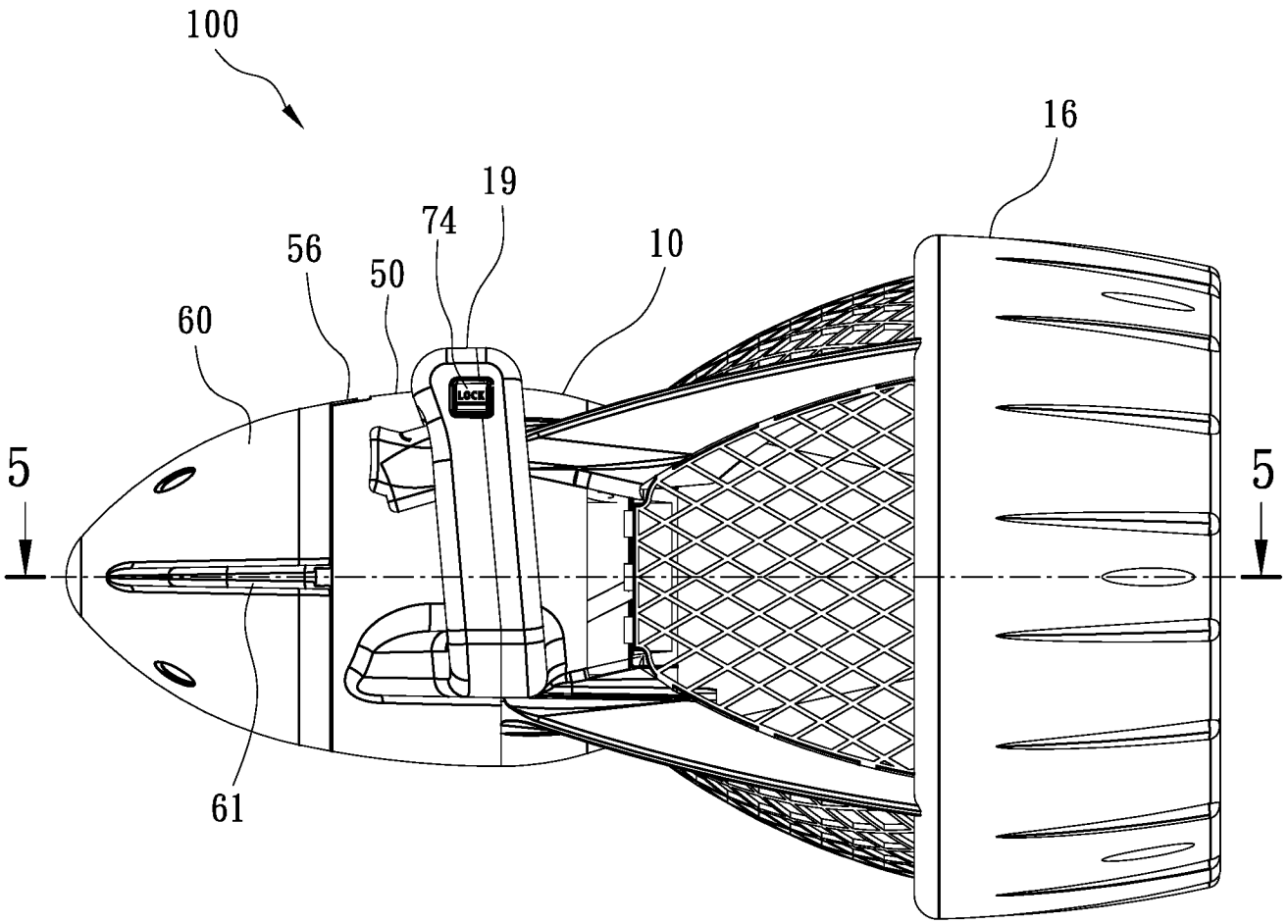
FIG. 3 is a side elevation of the underwater motive device of FIG. 1.
Figure 4:
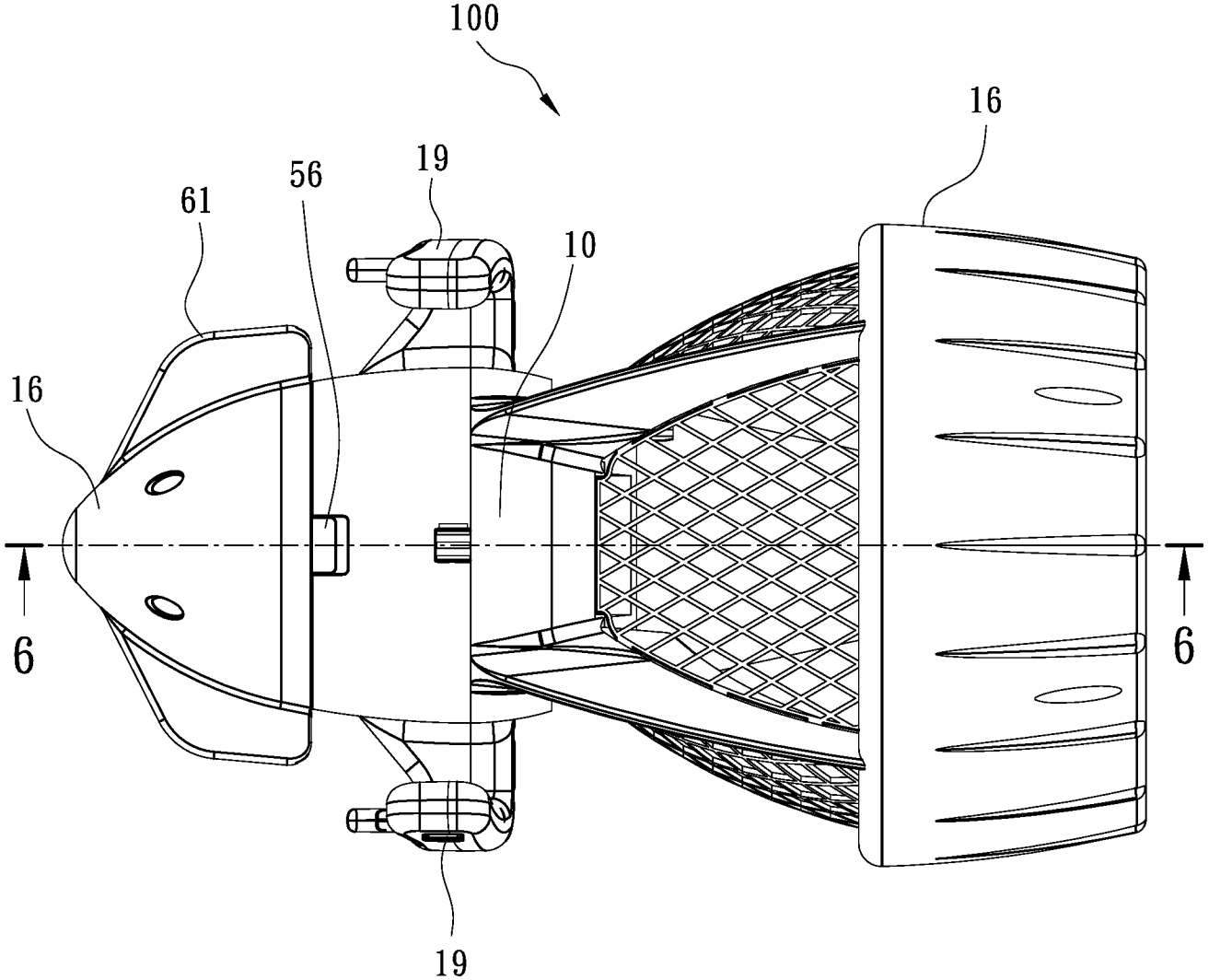
FIG. 4 is a top view of the underwater motive device of FIG. 1.

Embodiments of the invention will now be described, by way of example only, with reference to the accompanying drawings.

Referring to FIGS. 1 to 12, an underwater motive device 100 in accordance with a preferred embodiment of the invention comprises a rear main housing 10, a power mechanism 20, a propeller 30, a bridging housing 40, an intermediate housing 50, and a front cone 60 as discussed in detail below.

In the embodiment, the rear main housing 10 is a hollow cylinder having two open ends. The rear main housing 10 includes, on its inner surface 11, a plurality of longitudinal rear joining projections 12, a plurality of longitudinal rear fastening seats 13, and a plurality of spaced, projected circular arcs 17; on its outer surface, two opposite handle bar elements 14 on two sides respectively; and a plurality of fan main housing supports 15 extending rearward, and a fan main housing 16 supported by the fan main housing supports 15.

In the embodiment, the power mechanism 20 includes an electric motor 21, a gear train 20, and a driving shaft 23 for rotating the propeller 30.

In the embodiment, the bridging housing 40 has two open ends and a decreased diameter. The bridging housing 40 includes a battery compartment 41 with a battery 46 placed therein, and an internal power strip 461 configured to electrically connect to the battery 46, a control board 71 and the electric motor 21, a forward joining member 42, a shoulder 43 between the forward joining member 42 and an intermediate portion 401 of the bridging housing 40, and a rear joining member 44.

In the preferred embodiment, the forward joining member 42 includes an annular front end 421, an annular front surface 424 between the annular front end 421 and the shoulder 43, an O-ring 426 put on the annular front surface 424 and abutting the shoulder 43, two opposite first rails 422 on a joining portion of the annular front end 421 and the annular front surface 424, a first limit member 427 extending rearward out of an end of each of the first rails 422, and a first space 423 on the annular front surface 424 and between the O-ring 426 and each of the first rails 422.

In the preferred embodiment, the shoulder 43 is rearward of the forward joining member 42 and radially, outwardly extends a short distance out of the bridging housing 40. The shoulder 43 is a flat surface and has left and right sides in contact with a fastening seat 54 of the intermediate housing 50. Width of a portion of the shoulder 43 contacting the fastening seat 54 is greater than an outer diameter of the forward joining member 42 and height of the shoulder 43 is less than or equal to the outer diameter of the forward joining member 42.

Figure 5:
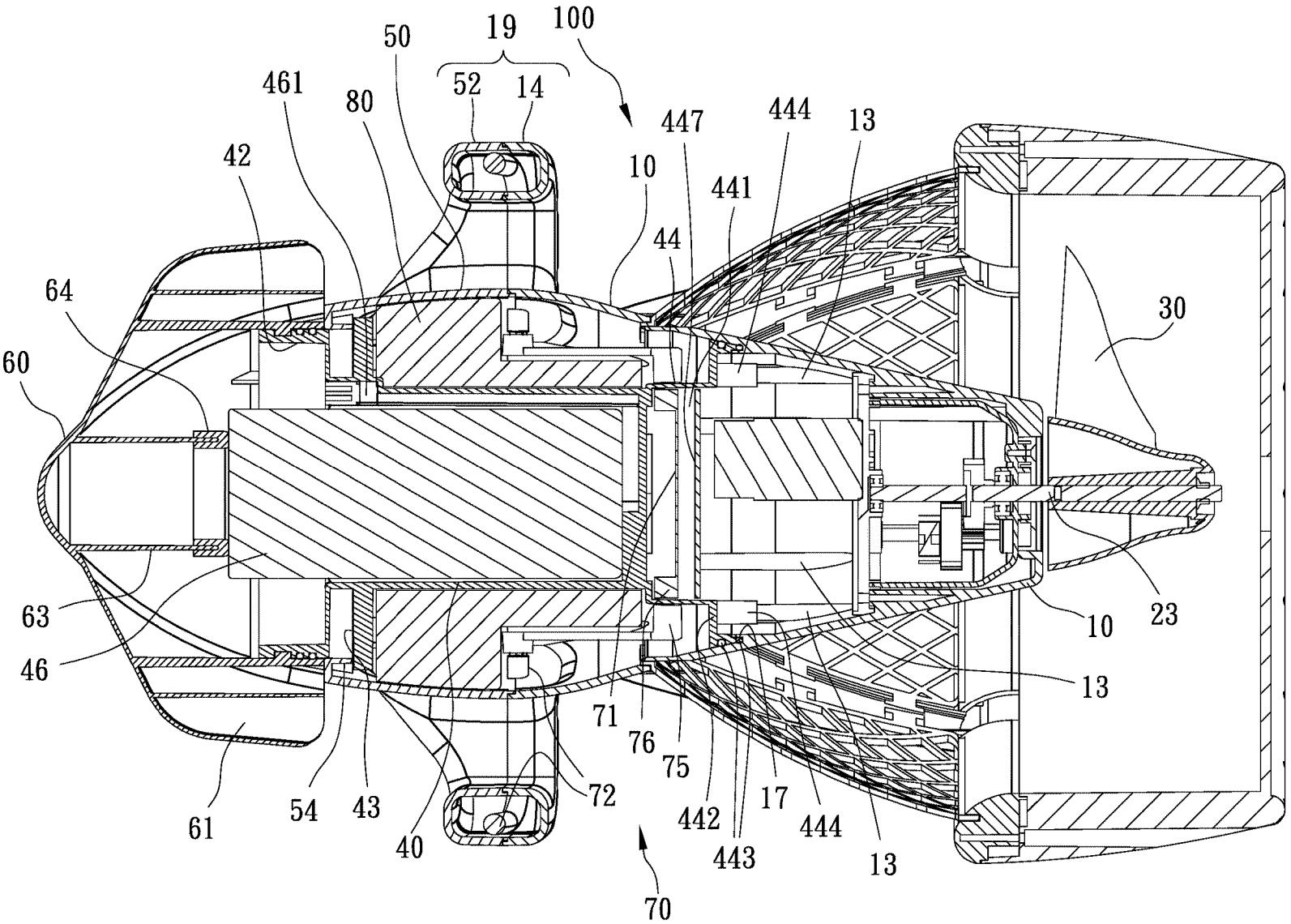
FIG. 5 is a sectional view taken along line 5-5 of FIG. 3.
Figure 6:
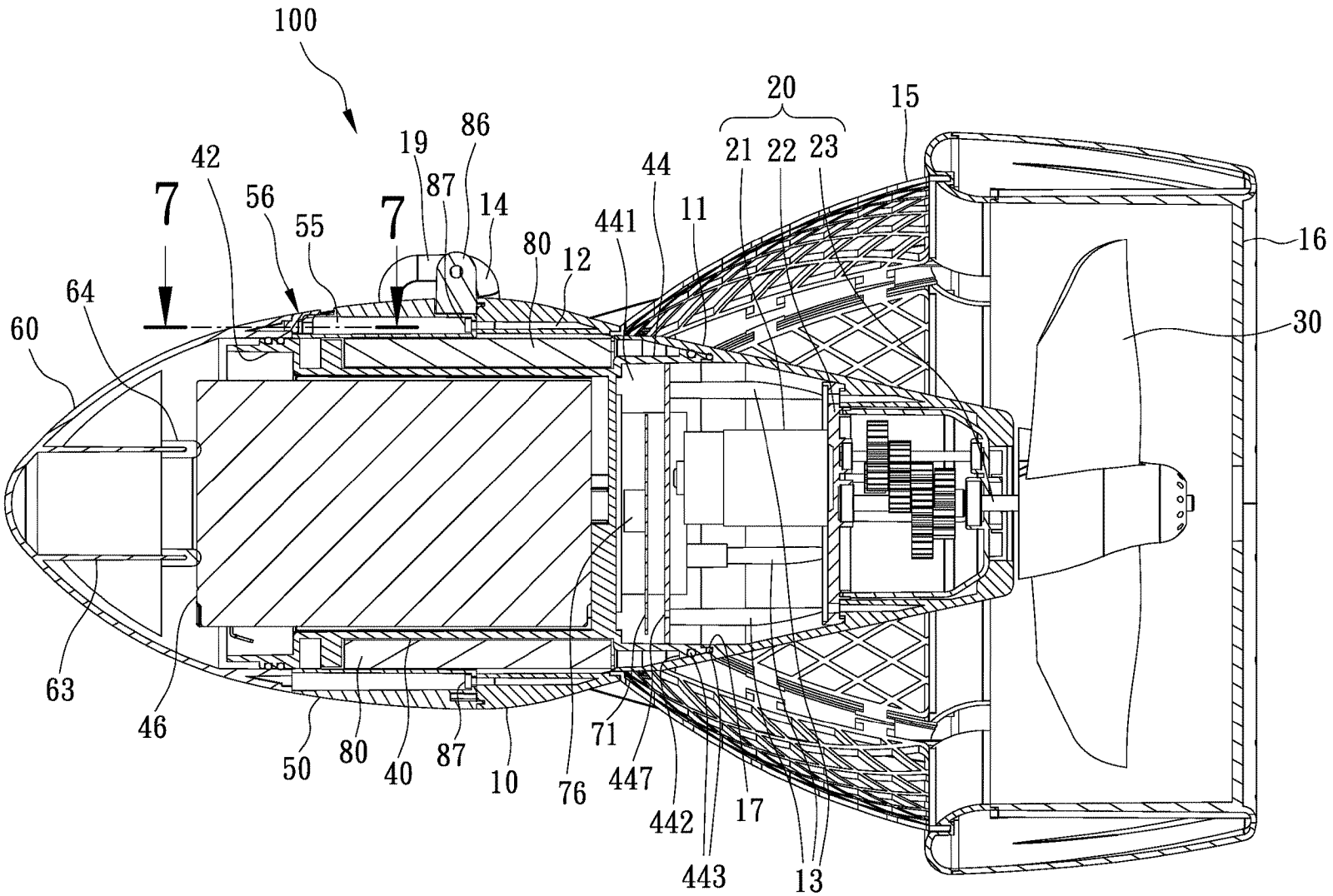
FIG. 6 is a sectional view taken along line 6-6 of FIG. 4.
Figure 7:
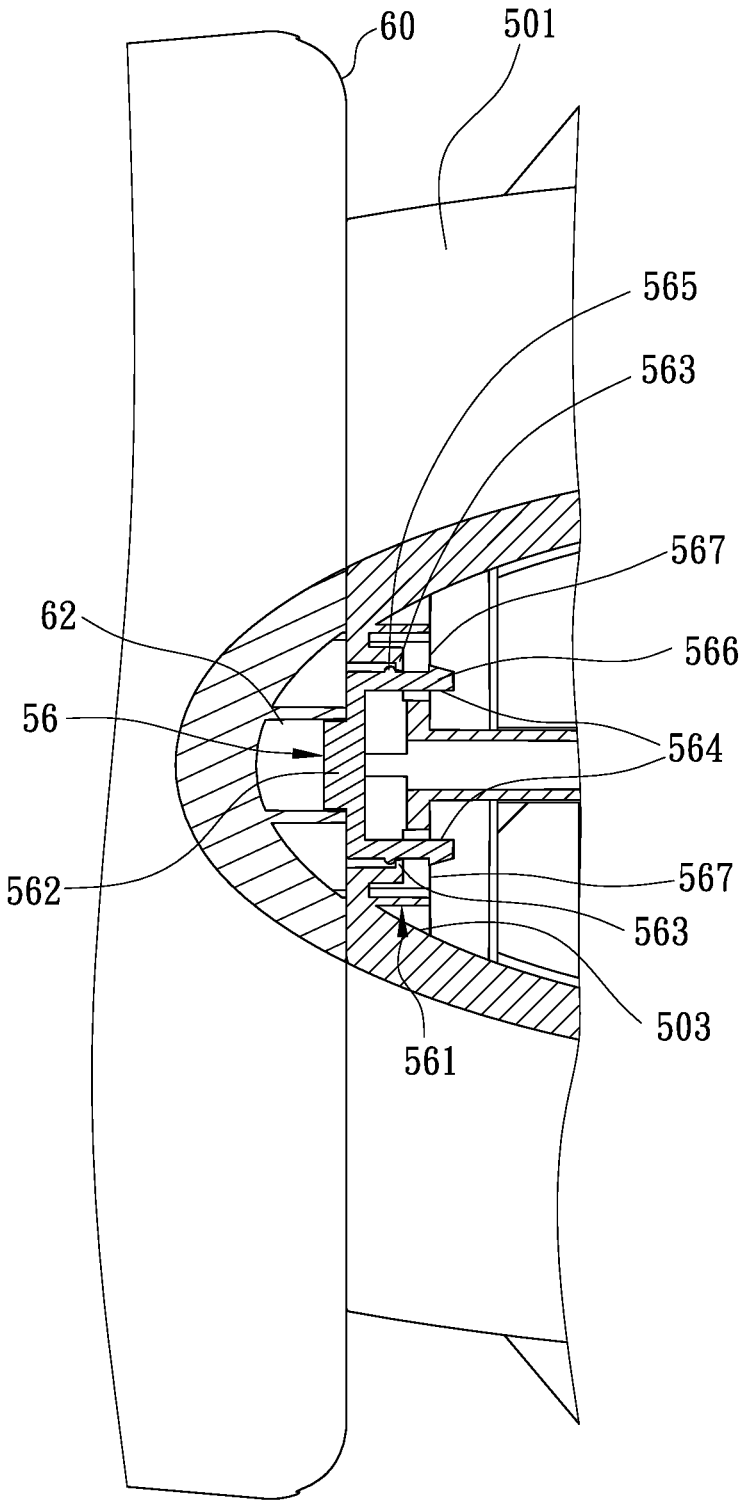
FIG. 7 is a sectional view taken along line 7-7 of FIG. 6 showing a locked position of the underwater motive device.
Figure 8:
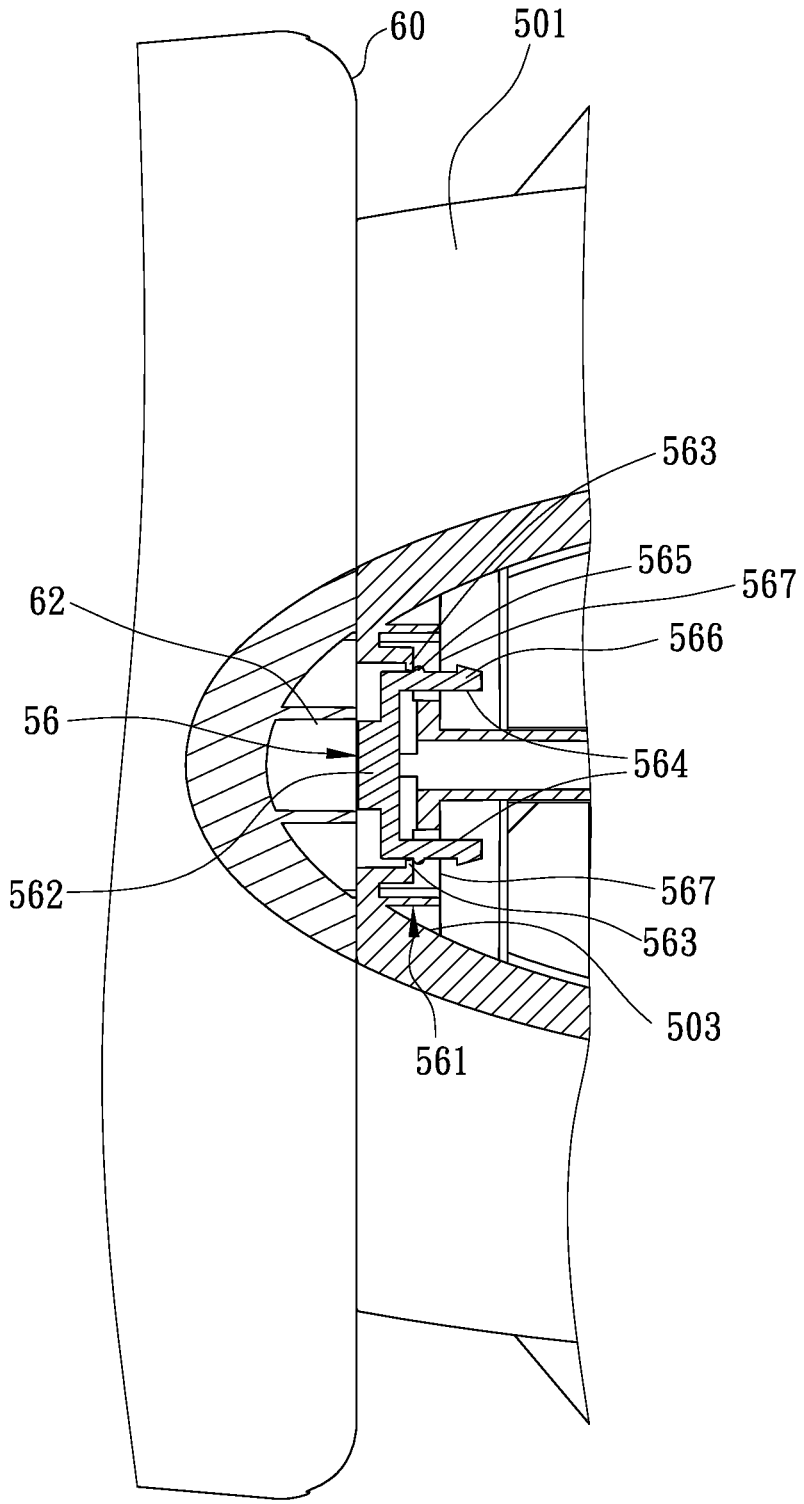
FIG. 8 is a view similar to FIG. 7 showing an unlocked position of the underwater motive device.
Figure 9:
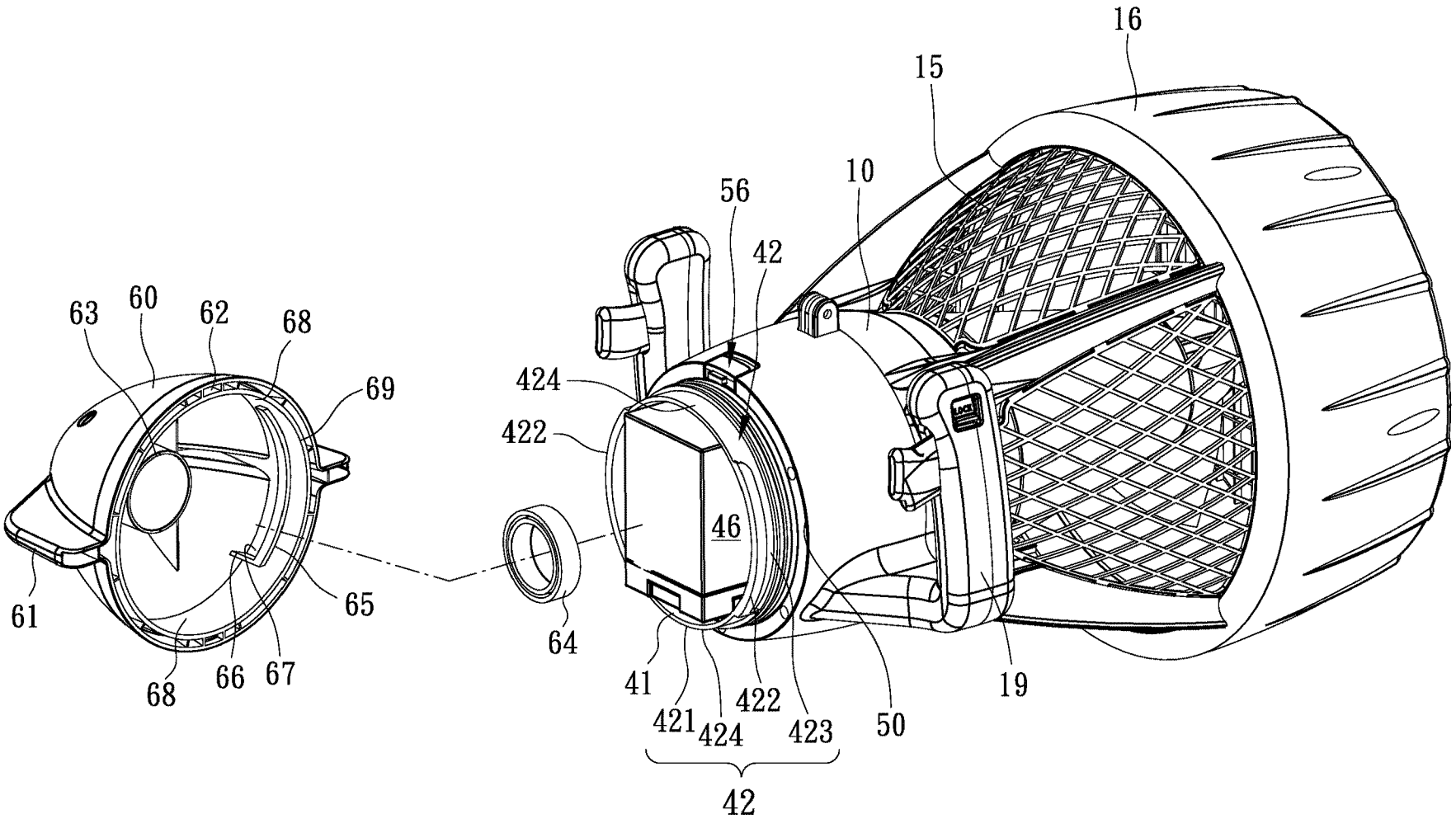
FIG. 9 is an exploded, perspective view of the underwater motive device showing the front cone detached from the intermediate housing.

In the embodiment, the rear joining member 44 is a rear extension of the bridging housing 40 and includes a compartment 441 open to a rear end, a wall 447 in the compartment 441, the wall 447 being made of aluminum and for separation and explosion-proof purposes, a rear annular member 442, an O-ring 443 disposed on the rear annular member 442, and a fastening seat 444 being rearward of the rear annular member 442 for a joining purpose as shown in FIG. 5.

In the embodiment, the intermediate housing 50 is a hollow cylinder and has two ends open. The intermediate housing 50 includes two opposite handle bar members 52 on two sides respectively, the handle bar members 52 configured to join the handle bar elements 14 in a mated relationship to form two opposite handle bars 19, and the internal annular limit element 54 at a front end, a plurality of longitudinal front joining projections 55 on an inner surface 51. On an inner surface 503 of a front portion 501 of the intermediate housing 50 there are provided a seat 561, a limit hole 567 adjacent to the seat 561, and two opposite tabs 563 in the limit hole 567. The intermediate housing 50 further comprises a detent 56 disposed on the front end of an outer surface of the intermediate housing 50 and including a seat 561, a trigger 562, two flexible latches 564 extending from the trigger 562, a protrusion 565 extending outward from each of the latches 564, and a hook 566 at each of the latches 564 being capable of movably disposing in the limit hole 567 to secure to the tab 563. Thus, the trigger 562 is locked in a normal position. The trigger 562 can be pressed to unlock the detent 56. In detail, in the locked position (see FIG. 7), the protrusions 565 are disposed forwardly of the tabs 563 and the trigger 562 projects out of the shoulder 50. In the unlocked position (see FIG. 8), the protrusions 565 are disposed rearward of the tabs 563 and the trigger 562 is flush with the shoulder 50. In short, a pressing of the trigger 562 can unlock the detent 56.

In the embodiment, the front cone 60 is tapered forwardly and includes a rear opening 69, two opposite fins 61 on two sides respectively for stabilization purpose, an aperture 62 on a rear end, a support member 63 on an inner surface of a front end, a ring 64 secured to the support member 63, an internal, annular surface 68 on a rear portion, and two opposite sets of a second rail 65, a second limit member 66 extending forward out of an end of the second rail 65, and a second space 67 disposed forwardly of the second rail 65. The sets of the second rail 65, the second limit member 66 and the second space 67 are formed on the internal, annular surface 68.

In the embodiment, there are further provided a controller 70, a hollow suspension cylinder 80, and a lug 86. The controller 70 includes the control board 71, a linking rod 72, a push button 73, and a lock 74. The control board 71 is provided in the compartment 441 of the rear joining member 44. Two opposite reed switches 76 are provided on the control board 71. A magnet 75 is provided at one end of the linking rod 72 and the push button 73 is secured to the other end of the linking rod 72. The push button 73 can be depressed to lock or unlock the lock 74. The power mechanism 20 can be activated or not by operating the controller 70. The hollow suspension cylinder 80 is made of foam material and configured to provide buoyancy of the underwater motive device 100. The hollow suspension cylinder 80 includes an axial channel 81 for accommodating the bridging housing 40, and a plurality of lengthwise grooves 82 on an outer surface.

The components of the invention have been fully described in the above paragraphs. Assembly of the invention is discussed in detail below. First, screws (not shown) are used to secure the power mechanism 20 to the rear fastening seat 13 of the rear main housing 10 with the driving shaft 23 extending out of the rear main housing 10 to operatively connect to and secure to the propeller 30. Next, the fan main housing supports 15 and the fan main housing 16 are joined. Next, the wall 447, the control board 71 and the fastening seat 44 of the bridging housing 40 are secured to the rear fastening seat 13 and thus the wall 447, the control board 71 and the fastening seat 44 of the bridging housing 40 are prevented from being rotated. The rear annular member 442 is urged against the projected circular arcs 17. The O-ring 443 serves to prevent leaking. Further, the linking rod 72, the push button 73, the lock 74 and a torsion spring 78 of the controller 70 are secured to the handle bar elements 14. The magnet 75 is disposed externally of the compartment 441 to align with the reed switch 76 and with the shell of the rear joining member 44 disposed therebetween. Next, the intermediate housing 50 is put on the bridging housing 40 in a front end to a rear end direction. The front joining projections 55 of the intermediate housing 50 are aligned with the rear joining projections 12 of the rear main housing 10 and screws 87 driven through the intermediate housing 50 into the rear main housing 10 to fasten them together. The annular limit element 54 urges against the shoulder 43 of the bridging housing 40 in a front end to a rear end direction (see FIG. 5). The bridging housing 40, the intermediate housing 50 and the rear main housing 10 are assembled by putting the annular limit element 54 of the intermediate housing 50, the projected circular arcs 17 of the rear main housing 10, the front joining projections 55 and the rear joining projections 12 together. Also, prior to assembling the intermediate housing 50, the hollow suspension cylinder 80 is put on the bridging housing 40 to fill a space between the bridging housing 40 and both the rear main housing 10 and the intermediate housing 50 with both the front joining projections 55 and the rear joining projections 12 disposed the grooves 82 in a mated relationship. As a result, structural strength of the underwater motive device 100 is greatly increased, and buoyance thereof is also increased to an optimum value. Further, the lug 86 is disposed between the intermediate housing 50 and the rear main housing 10.

Figure 12:
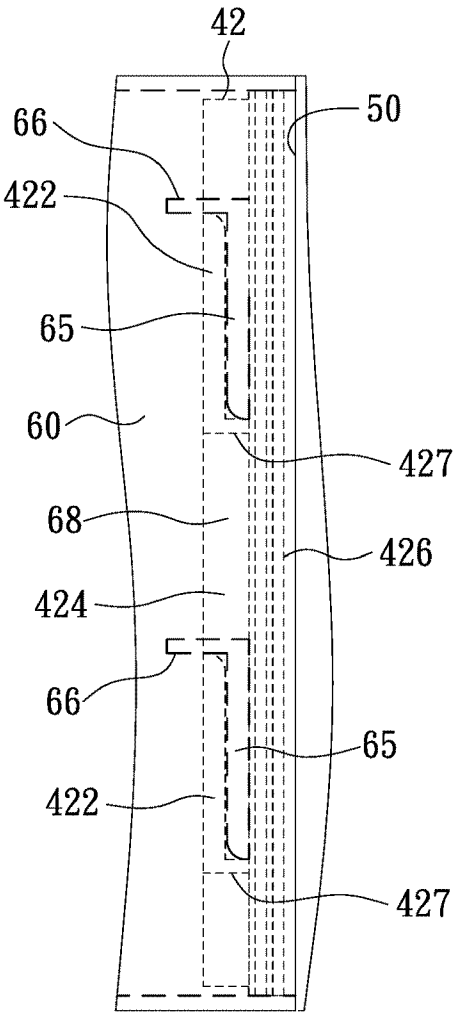
FIGS. 10, 11 and 12 schematically depict steps of assembling the front cone and the bridging housing.
Figure 11:
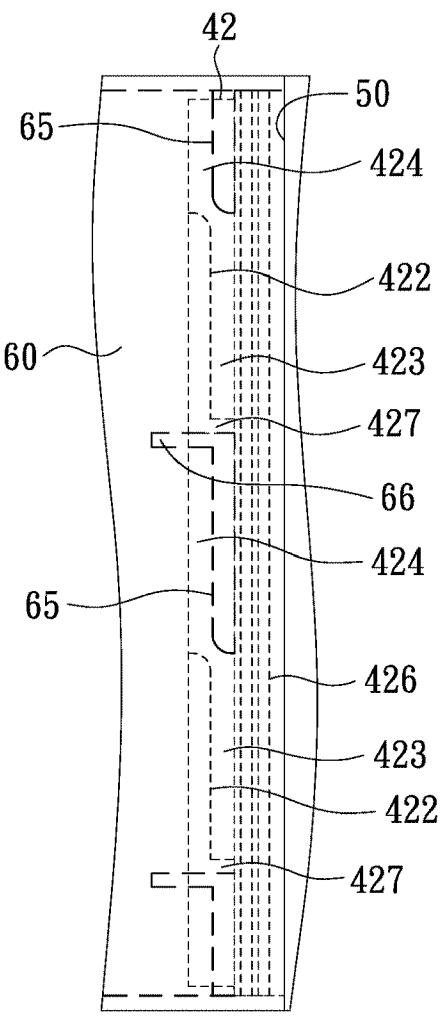
Figure 10:
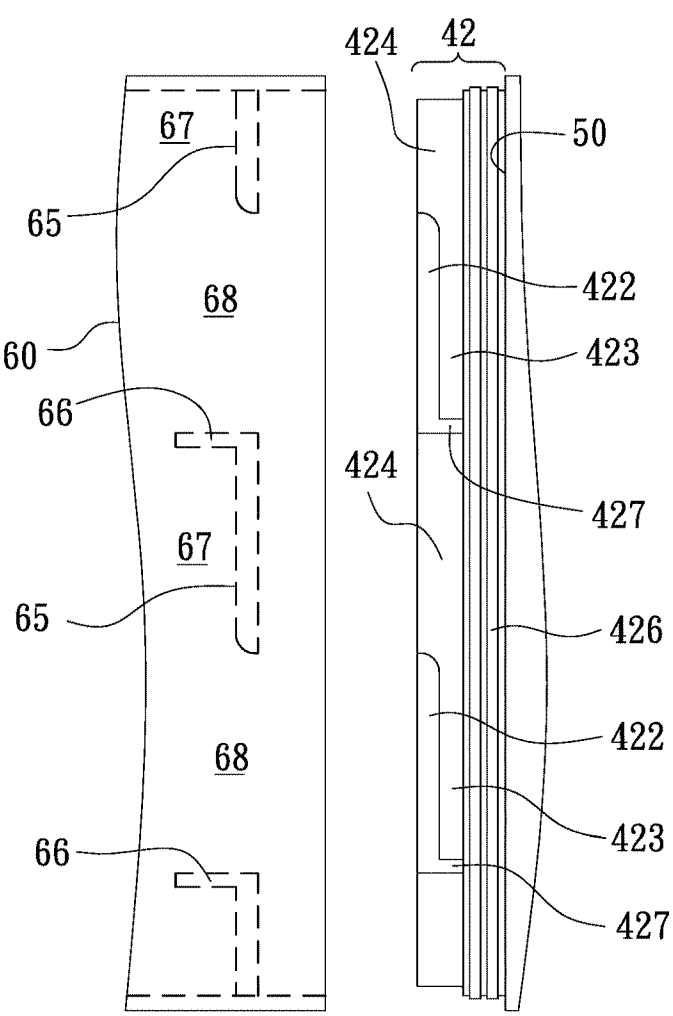

Referring to FIGS. 10 to 12 specifically, an assembly of the front cone 60 and the forward joining member 42 of the bridging housing 40 is discussed in detail below. The first rail 422 passes the internal, annular surface 68 until the front cone 60 is adjacent to the shoulder 43. Next, the front cone 60 is rotated to move the second rail 65 on the first space 423 until the second rail 65 is anchored by the first rail 422, the first limit member 427 and the O-ring 426 (see FIG. 12). In the above description, a movement distance of the second rail 65 is limited by the first limit member 427 and a movement distance of the first rail 422 is limited by the second limit member 66 respectively. Thus, both the first rail 422 and the second rail 65 are held in place. As a result, the front cone 60 and the forward joining member 42 are fastened and a waterproof arrangement is implemented in cooperation with the O-ring 426. Otherwise, water may enter the front cone assembly 100. Further, the battery 46 is mounted in the battery compartment 41 in cooperation with the support member 63 and the ring 64. Finally, the trigger 562 is inserted into the aperture 62 to lock the detent 56 (see FIG. 7), thereby finishing assembly of the underwater motive device 100. As shown in FIGS. 8, 10, 11 and 12, a pushing of the trigger 562 out of the aperture 62 disposes the detent 56 in the unlocked position, the second rail 65 next moves away from the annular front surface 424, and the second rail 65 and the first rail 422 are separated. As a result, the front cone 60 and the bridging housing 40 are separated.

While the invention has been described in terms of preferred embodiments, those skilled in the art will recognize that the invention can be practiced with modifications within the spirit and scope of the appended claims.

What is claimed is:

1. An underwater motive device, comprising:

a rear main housing including two opposite handle bar elements on two sides respectively, and a plurality of longitudinal rear joining projections on an inner surface;

a power mechanism disposed in a rear portion of the rear main housing and including a driving shaft extending out of a rear end of the rear main housing;

a propeller driven by the driving shaft;

a bridging housing including a battery compartment, a forward joining member, a shoulder between the forward joining member and an intermediate portion of the bridging housing, and a rear joining member;

an intermediate housing being a hollow cylinder and having two ends open, the intermediate housing including two opposite handle bar members on two sides respectively, the handle bar members configured to join the handle bar elements in a mated relationship to form two opposite handle bars, a plurality of longitudinal front joining projections on an inner surface, and an internal annular limit element at a front end wherein the bridging housing is in the intermediate housing, the front joining projections of the intermediate housing are aligned with the rear joining projections of the rear main housing, the annular limit element urges against the shoulder of the bridging housing in a front end to a rear end direction, and the forward joining member of the bridging housing extends out of a front end of the intermediate housing; and a front cone including a rear opening, for securing to the forward joining member of the bridging housing.

2. The underwater motive device as claimed in claim 1, wherein the forward joining member includes an annular front end, an annular front surface between the annular front end and the shoulder, two opposite first rails on a joining portion of the annular front end and the annular front surface, a first limit member extending rearward out of an end of each of the two opposite first rails, and a first space on the annular front surface and abutting each of the two opposite first rails, and two opposite sets of a second rail, a second limit member extending forward out of an end of the second rail, and a second space disposed forwardly of the second rail.

3. The underwater motive device as claimed in claim 2, wherein a movement distance of the second rail is limited by the first limit member and a movement distance of the first rail is limited by the second limit member respectively.

4. The underwater motive device as claimed in claim 1, wherein the front cone further comprises an aperture on a rear end, and wherein the intermediate housing further comprises a detent on a front end of an outer surface, the detent including a trigger configured to either insert into the aperture to secure the front cone and the intermediate housing together in a locked position or disengage from the aperture to separate the intermediate housing from the front cone in an unlocked position.

5. The underwater motive device as claimed in claim 4, wherein the intermediate housing further comprises a seat on an inner surface of a front portion, a limit hole adjacent to the seat, and two opposite tabs in the limit hole; wherein the detent further comprises two flexible latches extending from the trigger, a protrusion extending outward from each of the two flexible latches, and a hook at each of the two flexible latches; wherein the hook is configured to movably dispose in the limit hole to secure to the tab and further lock the detent in the locked position with the protrusion disposed forwardly of the tabs; and wherein the trigger is configured to press to unlock the detent in the unlocked position with the protrusion disposed rearward of the tabs.

6. The underwater motive device as claimed in claim 1, wherein the rear joining member includes a rear annular member urging against the spaced, projected circular arcs, an O-ring disposed on the rear annular member, and a fastening seat disposed rearward of the rear annular member for joining the rear main housing.

7. The underwater motive device as claimed in claim 1, wherein the shoulder radially, outwardly extends a predetermined distance out of the bridging housing.

8. The underwater motive device as claimed in claim 1, wherein width of a portion of the shoulder contacting the fastening seat is greater than an outer diameter of the forward joining member.

9. The underwater motive device as claimed in claim 2, wherein the front cone further comprises an aperture on a rear end, and wherein the intermediate housing further comprises a detent on a front end of an outer surface, the detent including a trigger configured to either insert into the aperture to secure the front cone and the intermediate housing together in a locked position or disengage from the aperture to separate the intermediate housing from the front cone in an unlocked position.

10. The underwater motive device as claimed in claim 9, wherein the intermediate housing further comprises a seat on an inner surface of a front portion, a limit hole adjacent to the seat, and two opposite tabs in the limit hole; wherein the detent further comprises two flexible latches extending from the trigger, a protrusion extending outward from each of the two flexible latches, and a hook at each of the two flexible latches; wherein the hook is configured to movably dispose in the limit hole to secure to the tab and further lock the detent in the locked position with the protrusion disposed forwardly of the tabs; and wherein the trigger is configured to press to unlock the detent in the unlocked position with the protrusion disposed rearward of the tabs.

* * * * *